United States Patent [19]

Loeffler

[11] 3,994,307

[45] Nov. 30, 1976

[54] APPARATUS FOR PERIODICALLY DELIVERING A PREDETERMINED QUANTITY OF A FLUID

[75] Inventor: Herbert H. Loeffler, Arlington, Mass.

[73] Assignee: Arthur D. Little, Inc., Cambridge, Mass.

[22] Filed: Mar. 29, 1976

[21] Appl. No.: 671,061

[52] U.S. Cl. ..... 131/171 R; 73/23; 417/415

[51] Int. Cl.[2] ..... A24F 13/00; A24F 47/00

[58] Field of Search ..... 131/171, 170, 172; 73/23, 28; 417/415, 419

[56] References Cited

UNITED STATES PATENTS

| | | | |
|---|---|---|---|
| 2,228,216 | 1/1941 | Morgan | 73/23 |
| 3,460,374 | 8/1969 | Parks | 131/171 R X |
| 3,548,840 | 12/1970 | Baumgartner | 131/171 R |

*Primary Examiner*—Stephen C. Pellegrino
*Attorney, Agent, or Firm*—Bessie A. Lepper

[57] ABSTRACT

An apparatus for delivering accurately metered volumes of a fluid at accurately spaced intervals. A pumping assembly including a cylinder, piston and fluid valving means are driven through a first cam which controls the volume of fluid pumped and a second cam, driven by the same synchronous motor used to drive the first cam, is used to control the engagement and disengagement of the first cam and hence to control the intervals between pumping cycles. When used as a smoking machine for animal tests, an additional air inhalation valve is provided and the apparatus is arranged to be connected to a gas reservoir attachable to the animal in a manner to create minimum interference with his normal breathing.

18 Claims, 9 Drawing Figures

APPARATUS FOR PERIODICALLY DELIVERING A PREDETERMINED QUANTITY OF A FLUID

This invention relates to apparatus for delivering accurately metered amounts of a fluid at accurately spaced intervals, and more particularly to such apparatus for delivering a test gas in which particular material, in the form of liquids and/or solids, is entrained.

A very important use for apparatus capable of delivering metered amounts of gas at spaced intervals is in animal smoking experiments used to simulate the effect of cigarette smoking on human beings. In order to obtain statistically meaningful results from such experiments, it it necessary to have an apparatus which delivers a consistently uniform quantity of the gas at accurately spaced intervals in a manner to insure that the test animal inhales the gas in a consistent manner. Since such tests are normally carried out over extended time periods, it is essential that such apparatus be capable of running unattended and without maintenance for long periods. It is further essential that the apparatus function in such a manner that it has a minimum effect on the gas itself so that the apparatus introduces no important additional unwanted variables into the experiment in which it is being used. Finally, it is highly desirable that such apparatus be simple to disassemble for cleaning, essentially silent in operation and readily adaptable for incorporation into different types of breathing equipment.

There are a number of cigarette smoking machines described in the prior art. (See for example U.S. Pat. Nos. 2,228,216, 3,433,054, 3,460,374, 3,476,119, 3,528,435, 3,548,840, 3,548,841, 3,586,007 and 3,732,874). The apparatus represented by these patents are complicated in structure and function and do not meet all of the above-detailed criteria. There is, therefore, a need for an improved apparatus particularly for use in cigarette testing and generally for those users requiring the delivery of accurately metered volumes of gases at accurately spaced intervals. For the sake of convenience, the apparatus of this invention will be described in terms of delivering cigarette smoke. It is, however, within the scope of this invention to use this apparatus for delivering fluids, and more particularly gases other than air and containing particulate materials other than tars and the like which are associated with cigarette smoke.

It is therefore a primary object of this invention to provide improved apparatus for delivering accurately metered volumes of a fluid at accurately spaced intervals. Another object of this invention is to provide apparatus of the character described which is capable of performing consistently over extended periods of time without maintenance, which is simple to construct and easily cleaned, which exerts a minimum effect on the fluid and its entrained material passing therethrough, and which is quiet in operation.

Another primary object of this invention is to provide an improved smoking machine capable of being incorporated into smoking systems for carrying out experimental evaluations of smoking material, particularly cigarettes.

Other objects of the invention will in part be obvious and will in part be apparent hereinafter.

According to one aspect of this invention there is provided an apparatus for delivering predetermined volumes of a test fluid at predetermined frequency levels which comprises a pumping means and a driving means. The pumping means, in turn, comprises a cylinder terminating in a valving extension having therein a fluid passage which communicates with a fluid chamber definable within the cylinder; a piston terminating in a piston rod and moving within the cylinder, with a friction fit, to determine the volume of the cylinder chamber and hence of the fluid pumped; and a valve block arranged to permit therein the reciprocating motion of the cylinder valving extension and defining a fluid inlet passage and a fluid discharge passage alternately in communication with the fluid passage in the cylinder valving extension. The driving means comprises a upper first cam having cam surfaces for controlling the motion of the cylinder valving extension and the motion of the piston in the cylinder; a lower second cam having at least one peripheral lifting ramp; a drive pin engageable with the first cam surfaces arranged to move up and down in the piston rod from a lower to an upper position by engagement with a lifting ramp on the second cam; a spring in compression to maintain the drive pin in its lower position so that it engages the upper cam surfaces only when it is raised by the second cam; and means to rotate the first and second cams at predetermined relative angular velocities which along with the spacing of the lifting ramps on the second cam determine the frequency with which the pumping of the fluid is carried out.

According to another aspect of this invention, the valve block includes a one-way inhalation check valve so that when the apparatus is used as a smoking machine, it may be connected to a gas reservoir and fitted to an experimental animal. By providing the reservoir with a one-way exhalation check valve, the animal may breathe freely and naturally with the assurance that all of the smoke generated by pumping air through a tobacco product is inhaled by the animal.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings in which FIG. 1 is a perspective view of the gas delivery apparatus of this invention;

Figure 1:
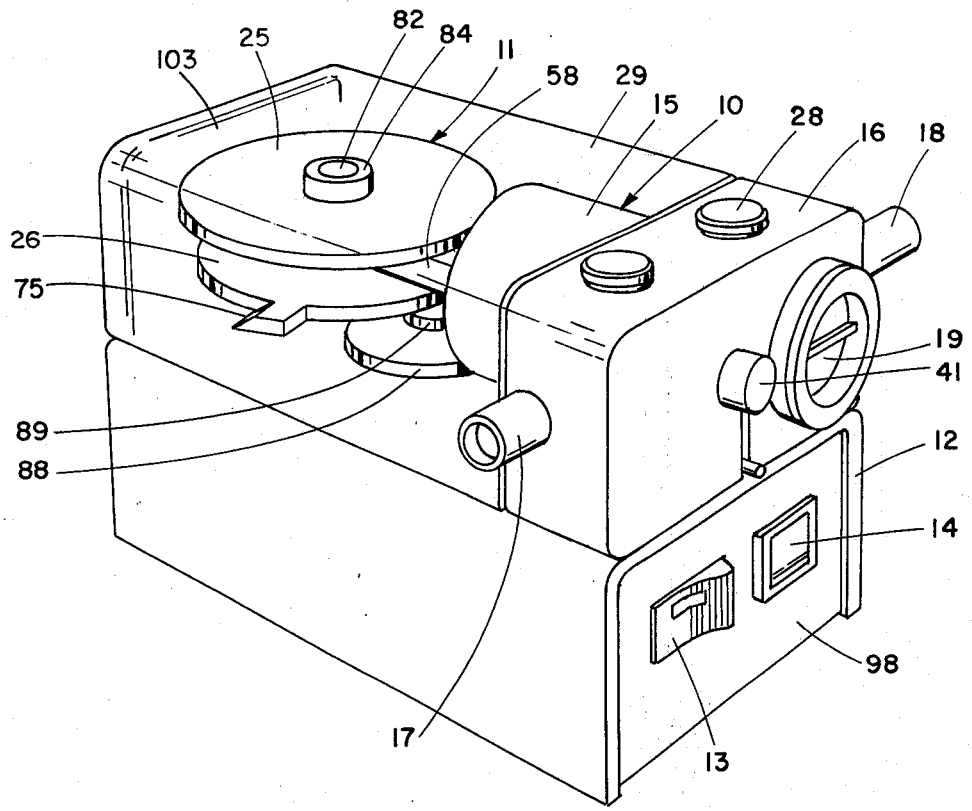

As noted previously, it will be convenient to describe the apparatus of this invention in terms of its serving as a cigarette smoking machine. As will be seen in the perspective view of FIG. 1, the apparatus is comprised of a pump assembly, generally indicated by the reference numeral 10, and a drive assembly, generally indicated by the reference numeral 11. These pump and drive assemblies are mounted on a support housing 12 which houses the single electric drive motor and control mechanisms including the externally operable on-off switch 13 and a fuse switch 14. Pump assembly 10 includes a cylinder/piston component 15 and a valve block 16 in which fluid passages are defined (described with reference to FIGS. 3 and 5) and in which a gas inlet connector 17 and gas outlet connector 18 are mounted. In those applications where the apparatus is to be used to periodically deliver a test gas (e.g., cigarette smoke) to a breathing animal subject, then it is necessary to also provide an inhalation valve 19 in order that the test animal may inhale air between those periods when the test gas is delivered.

The drive assembly 11 comprises an upper first cam 25 which controls the duration of test gas flow through the apparatus and a lower second cam 26 which controls the frequency of test gas flow. A piston rod 27 carrying a cam follower pin (not shown in FIGS. 1 and 2) provides the connection between the pump and drive assemblies.

Figure 2:
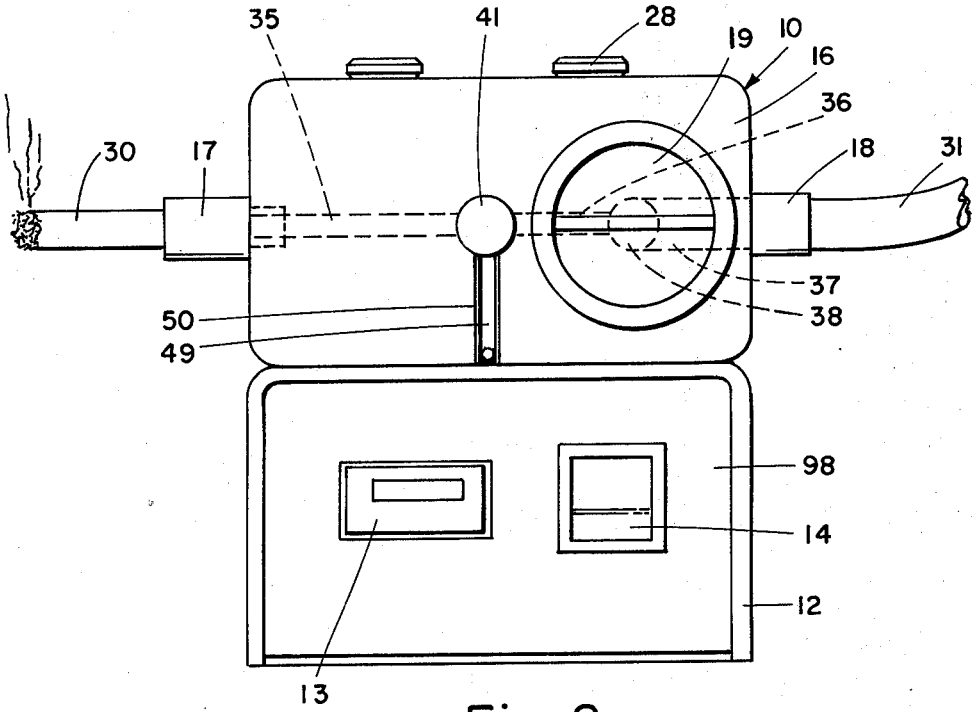
FIG. 2 is an end view of the gas delivery apparatus of FIG. 1 shown being used as a smoking machine.
Figure 9:
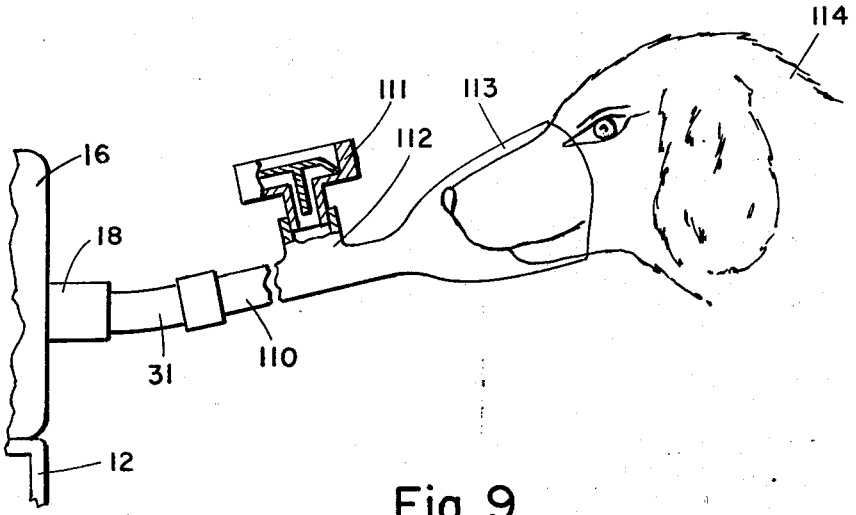
FIG. 9 is a perspective view of the apparatus of this invention incorporated in a cigarette test system.

Valve block 16 is affixed to housing support 12 through two easily removable screws 28 and the drive and pump assemblies may be covered with a pivotally mounted cover member 29, shown in FIG. 1 to be formed of a transparent plastic. When the apparatus is used as a smoking machine, as shown in FIG. 2, the smoking material, e.g., cigarette 30 is placed in the inlet connector 17 and a tubing 31 is inserted into outlet connector 18. FIG. 9 shows tubing 31 leading to an appropriate breathing mask assembly.

Figure 5:
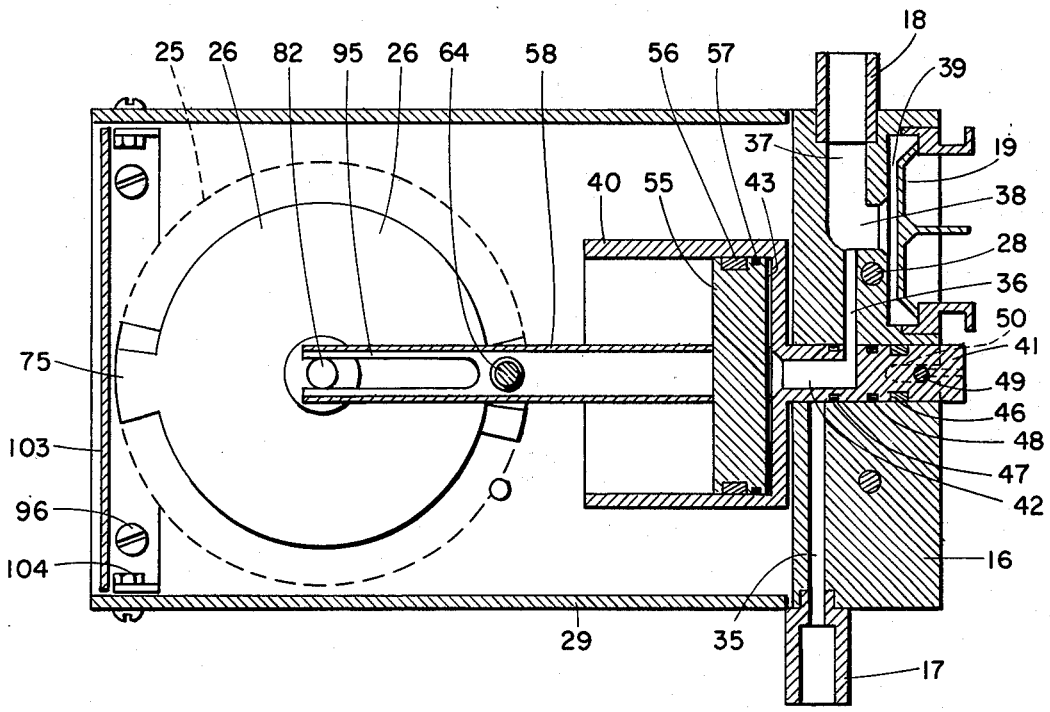
FIG. 5 is a cross sectional view of the apparatus of FIG. 3 taken through plane 4—4 of FIG. 3.

As will be seen in FIG. 5, valve block 16 defines a test gas inlet passage 35 which communicates with test gas inlet connector 17 and a test gas outlet passage formed as a smaller diameter section 36 which leads into a larger diameter section 37, the latter of which communicates with test air outlet connector 18. The larger diameter section 37 of the outlet passage branches at 38 to communicate with the inlet section of inhalation valve 19. Thus during those periods when a test gas, e.g., cigarette smoke, is not passing through the apparatus, ambient air may be freely drawn in through inhalation valve 19. It will be seen that test gas inlet passage 35 and test gas outlet passage section 36 are offset from each other, thus allowing them to be alternately opened and closed through reciprocating action of the cylinder of the piston/ cylinder component of the driving assembly.

Figure 3:
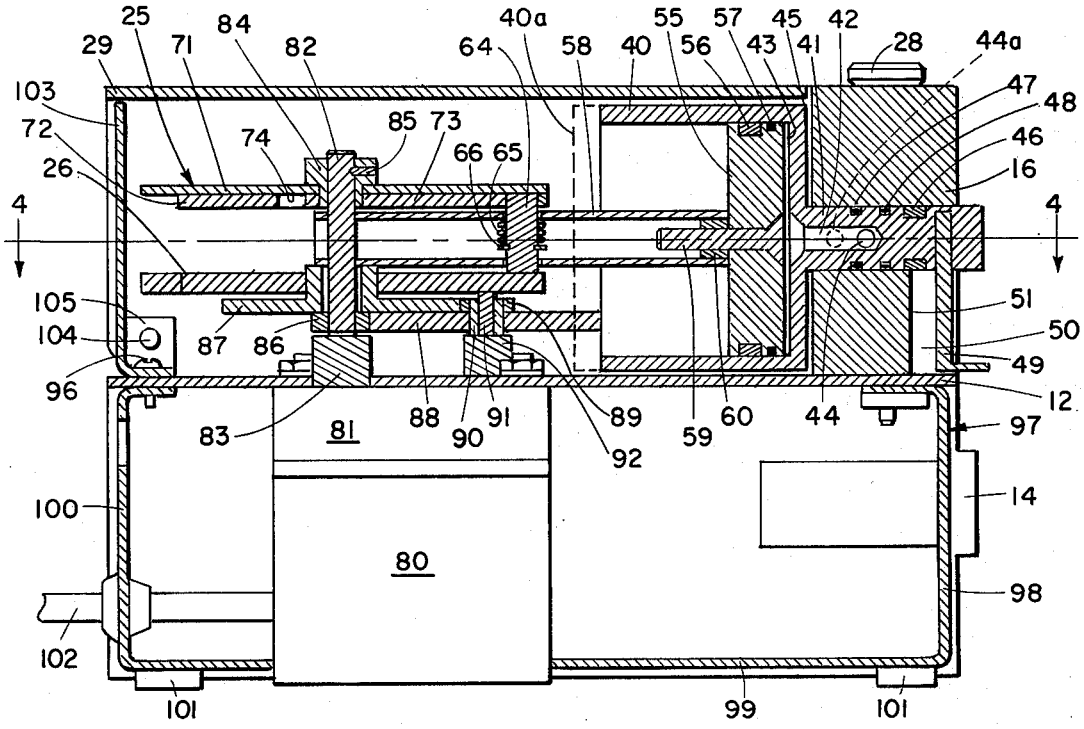
FIG. 3 is a longitudinal cross section of the apparatus of FIG. 1 showing the driving pin in engagement at the beginning of an inhalation period of the operational cycle.

The piston/cylinder component 15 comprises a cylinder 40 which has integral therewith a cylinder extension 41 defining a fluid passage 42 opening into the internal volume 43 of the cylinder. Cylinder extension 41 has a transverse passage 44 drilled through it to provide a fluid port such that inlet passage 35 in valve block 16 is in communication with passage 42 when the cylinder 40 is advanced to its intake position as indicated by dotted lines 40a and 44a and outlet passage 36 is in communication with passage 42 when the cylinder is returned to its discharge position as shown in FIG. 3. Cylinder extension 41 has associated with it a wiping ring 46 and o-ring seals 47 and 48. The wiping ring 46 is saturated with a lubricant that picks up accumulated tars from the cigarette smoke and deposits lubricant for each cycle of operation. Thus self-cleaning is attained, an important feature when an experimenter is using a large number of smoking machines simultaneously. Mounted in cylinder extension 41 is a limit pin 49 which moves within a slot 50 cut in valve block 16. Slot 50 is of a depth such that travel of the cylinder toward the driving assembly is stopped when limit pin 49 engages the inner surface 51 of slot 50.

A piston 55, having a wiping range 56 and o-ring seal 57, is friction fit within cylinder 40. Wiping ring 56, like wiping ring 46, is saturated with lubricant and provides the desired self-cleaning feature for the piston. Piston 55 is mechanically linked to the driving mechanism through a hollow piston rod 58 which is joined to piston 55 by means of a screw 59 engaging a plug 60 sealing the end of the piston rod.

Because piston 55 is friction fit within cylinder 40, the cylinder is drawn toward the drive assembly to the extent that limit pin 49 permits such forward motion before piston 55 moves within cylinder 40 to pump in gas through test gas inlet 17 and passage 35. At this intake position of cylinder extension 41, port 44 is aligned with intake passage 35. Further motion of piston 55 then serves to increase cylinder volume 43, thus providing for the intake, or inhalation, of the test gas into the pump. Once the inhalation portion of the cycle is completed, the movement of piston 55 back toward the valve block forces cylinder 40 back until it engages inner wall 45 of valve block 16. Fluid port 44 is then aligned with discharge passage 36 and the further movement of piston 55 within cylinder 40 pumps the inhaled gas out of cylinder 40 into test gas outlet 18 until piston 55 reaches the position shown in FIG. 3.

Figure 4:
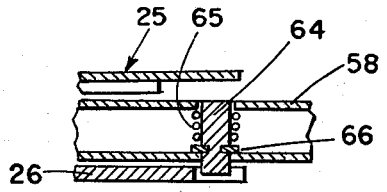
FIG. 4 is a fragmentary cross section of the driving pin and cams showing the driving pin in its normal disengaged position.

A drive pin 64 is attached to piston rod 58 so that its axis is transverse to that of the piston rod so that it may experience translational motion with respect to the piston rod. Drive pin 64 is spring-loaded downwardly by compressive spring 65 seated on a limit ring 66 fastened to pin 64. This drive pin 64 can only move up and down and in its normal rest position, as shown in FIG. 4, it is down riding clear of the bottom cam 26 and out of engagement with the cam surfaces which are on the under side of upper cam 25. An important feature of the apparatus of this invention resides in the use of a single synchronous electric motor to drive and time the pump with respect both to the duration of the puff (test gas intake period) and to the spacing of the puffs (frequency of test gas intake). This is accomplished through the use of the upper and lower cams in combination, both being driven by this single synchronous motor.

Figure 6:
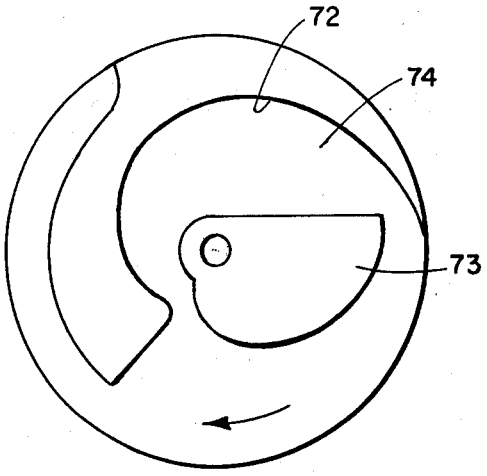
FIG. 6 is a plan view of the bottom surface of the upper cam which controls the duration of gas flow through the apparatus.

The upper cam, generally indicated by the reference numeral 25, comprises a mounting plate 71 in the form of a circular disk having intake cam surface 72 and discharge cam surface 73 defined on the bottom surface 74 (FIG. 6). When drive pin 64 is forced into engagement with intake cam surface 72, the rotation of upper cam 25 in the direction indicated by the arrow in FIG. 6 effects first the forward movement of cylinder 40 to position 41a and then the motion of piston 55 to pump in test gas as explained above. Continued rotation of cam 25, while engaged with drive pin 64 brings the drive pin into engagement with discharge cam 73 which in turn effects the backward motion of cylinder 40 and then the motion of piston 55 within cylinder 40 to pump out the test gas.

Figure 8:
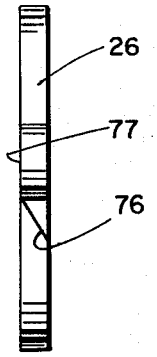
FIG. 7 and 8 illustrate the bottom cam, top plan and side elevational views, which controls the frequency of gas flow.
Figure 7:
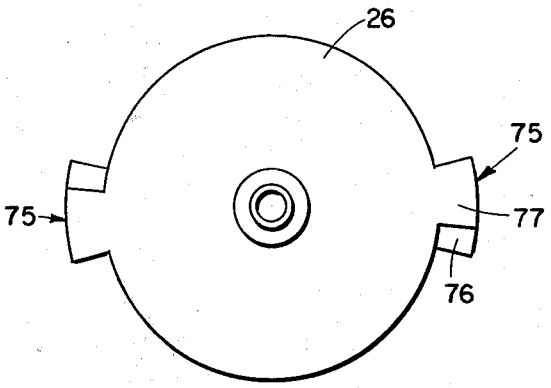

Inasmuch as the purpose of lower cam 26 is to accurately space the gas intake/discharge period, this lower cam serves the function of forcing drive pin 64 out of its normal down disengaged position (FIG. 4) into engagement with the cam surfaces 72 and 73 for the desired time period. As will be seen more clearly in FIGS. 7 and 8, cam 26 is in the form of a circular disk having oppositely disposed peripherial lifting ramps 75 formed of an inclined ramp section 76 and a flat engagement section 77. These lifting ramps are so sized and spaced around lower cam 26 as to maintain drive pin 64 in engagement with cams 72 and 73 for that time period required to complete one intake/discharge period. As will be seen in FIGS. 7 and 8, the lower cam 26 brings about two such intake/discharge periods in one revolution.

The lower cam may, of course, have one or more lifting ramps 75 which are spaced at predetermined intervals. If the test gas is to be delivered at equally spaced intervals then the lifting ramps will also be equally spaced around the periphery of the lower cam. It is also, of course, within the scope of this invention to deliver the test gas over a period cycle, each of which includes unequally spaced intervals. In this latter case, the lifting ramps 75 are unequally spaced to correspond with the desired interval spacings.

In any case, the lower cam can select to cycle every time the upper cam is in the start position. Thus, for example, with a 20 rpm upper cam and a one-rpm lower cam, any number up to 20 cycles can be made.

Cams 25 and 26 are driven by a synchronous electric motor 80 having reduction gearing 81 which turns the motor shaft 82 at a fixed speed, e.g., 20 rpm. Shaft 82 extends upward through a bearing 83 to a hub 84 which is affixed to the shaft through a pin 85. Cam 25 is mounted to main motor shaft 82 through hub 84. A driving gear 86 is press-fitted onto shaft 82 and drives lower cam gear 87 through idler gears 88 and 89, these idler gears being mounted through bushing 90 on shaft 91 supported by block 92. In this arrangement the bottom cam 26 free wheels on the motor shaft 84.

Since the lower cam determines the spacing of the intervals between the pumping of the test gas, it is driven at an angular velocity which is less than that at which the upper cam is driven. The relative angular velocities of the two cams in combination with the number and spacing of the lift ramps on the bottom cam therefore determine the actual time intervals between pumping actions.

As will be seen from FIGS. 3 and 5, piston rod 58 is bifurcated to have oppositely disposed terminal arms 95 which ride on either side of main shaft 82 between cams 25 and 26. Thus piston rod 58 is guided by shaft 82 to prevent putting any side loads on the pump.

The support housing 12 has bolted thereto, through valve block screws 28 and screws 96, an auxiliary housing member 97 which provides a front panel 98, a bottom panel 99 and a back panel 100. Four feet 101 are affixed to bottom panel 99 and suitable electrical connection 102 to motor 80 pass through back panel 100. The cover 29 is perferably pivotally mounted so that it may be swung upwardly and backwardly. This is done by forming cover 29 as a three-sided member and providing a rigidly affixed, upper back panel cover 103 mounted through screws 96 to support housing 12. Pivotal cover 29 is then mounted through screws 104 in short vertical side extensions 105 of back panel cover 103.

In smoking experiments the standard puff profile consists of drawing 35 ml of air through a burning cigarette over a period of two seconds. This is repeated every 30 seconds. Thus the pumping assembly of the apparatus of this invention, when used for animal smoke experiments, is sized to inhale 35 ml of gas, and upper cam 25 is sized, configured and rotated at an appropriate rate to perform this pumping in two seconds. The lower cam 26 must, of course, be rotated at a speed relative to that of the upper cam and have an appropriate number of equally spaced lifting ramps to define the desired intervals between pumping action. Hence to achieve the standard puff profile, the upper cam is rotated at 20 rpm and the lower cam at 1 rpm. It is, of course, within the scope of this invention to achieve other protocols both with respect to the amount of test gas delivered and the frequency at which it is delivered.

It will be apparent from the above description of the apparatus that the desired accuracy is attained both with regard to the amount of test gas delivered and the frequency of delivery. By using a piston and cylinder and by drawing the piston through a fixed stroke a fixed displacement is obtained. By driving the piston with a cam driven by a synchronous motor accurate timing is attained. Thus the single synchronous motor, which is not load- or voltage-sensitive, performs all of the mechanical functions of the machine consisting of timing the intervals between puffs, timing the length of each puff, and operating the valves that permit the machine to take in the test gas and expel it into a tube or reservoir.

FIG. 9 illustrates a typical way in which the test gas delivery apparatus of this invention may be used in an animal smoking experiment. The tubing 31 is integral with or connected to an air storage tube 110 which has a one-way exhalation valve 111 in a branch tubing 112 and which terminates in a suitably configured adapter 113 to fit over the muzzle of the animal 114. The cigarette smoke is thus stored in tubing 110. The animal is free to breathe at all times since inlet valve 19 is continuously in direct communication with discharge passage 37 (FIG. 5) and ambient air can be taken in through the system whenever the animal inhales. Exhaling by the animal will open valve 111 but will not discharge any of the test gas therethrough.

After an extended period of use it is desirable to remove accumulated tars and particulate material from the pumping assembly. Removing screws 28 makes it possible to lift off the valve block and pull out the pump assembly. The piston may then be withdrawn from the cylinder so that all the surfaces which may have tars built up on them may be cleaned and wiping rings and seals replaced if necessary. Reassembly is likewise a simple matter of putting these three pieces back in their proper position.

The apparatus of this invention provides means for delivering accurately metered quantities of a test gas at accurately spaced intervals, the apparatus being capable of prolonged operation and simple to clean, and of a type which exerts a minimum effect on the test gas being handled. The apparatus is particularly suited for a smoking machine used in animal smoking experiments.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

I claim:

1. An apparatus for delivering predetermined volumes of a test fluid at predetermined frequency intervals, comprising in combination a. pumping means comprising 1. a cylinder terminating in a valving extension having therein a fluid passage which communicates with a fluid chamber definable within said cylinder;
2. a piston terminating in a piston rod and movable within said cylinder, with a friction fit, thereby to determine the volume of said fluid chamber and hence the volume of said test fluid pumped in a pumping cycle;
3. valve block means arranged to permit therein reciprocating motion of said valving extension of said cylinder and defining a fluid inlet passage and a fluid discharge passage alternately in communication with said fluid passage in said valving extension in its reciprocating motion; and b. driving means comprising 1. upper first cam means having cam surfaces for controlling the motion of said cylinder valving extension within said valve block means and the motion of said piston within said cylinder;
2. lower second cam means having at least one peripheral lifting ramp;
3. a drive pin engageable with said cam surfaces of said first cam means mounted transverse to the axis of said piston rod and arranged for translational movement therein from a lower to an upper position by engagement with said at least one lifting ramp of said second cam means;
4. compressive spring means arranged to maintain said drive pin in said lower position whereby said drive pin engages said cam surfaces of said first cam means only when it is raised by said at least one lifting ramp of said second cam means; and
5. motor means, including gear means, for rotating said first and second cam means, the angular velocity of said second cam means being less than that of said first cam means and in combination with the relative position of said at least one lifting ramp on said second cam means determining the frequency with which said first cam means is engaged by said driving pin and thereby the frequency of the pumping of said test fluid.

2. An apparatus in accordance with claim 1 wherein said valving extension of said cylinder has sealing means and wiping ring means for sealing and cleaning the contacting surfaces of said valving extension and said valve block means.

3. An apparatus in accordance with claim 1 including means to limit the extent of said reciprocating motion of said cylinder extension in said valve block means.

4. An apparatus in accordance with claim 1 wherein said piston has sealing means and wiping ring means for sealing and cleaning the contacting surfaces of said cylinder and said piston.

5. An apparatus in accordance with claim 1 wherein said valve block means includes a branch fluid passage in communication with said fluid discharge passage and a one-way fluid inlet valve associated with said branch fluid passage.

6. An apparatus in accordance with claim 1 wherein said second lower cam means is a circular disk and has a plurality of said peripheral lifting ramps equally spaced around its periphery.

7. An apparatus in accordance with claim 1 wherein said upper first cam means comprises a mounting plate having as said cam surfaces an intake cam surface and a discharge cam surface defined on the bottom surface of said mounting plate and said first upper cam means is mounted such that said cam surfaces face said second lower cam means.

8. An apparatus in accordance with claim 7 wherein said first and second cam means are mounted in axial alignment in spaced apart relationship on a common shaft, said first cam means being attached to said shaft and said second cam means being free wheeling thereon.

9. An apparatus in accordance with claim 8 wherein said piston rod is bifurcated to have oppositely disposed terminal arms which ride on either side of said common shaft between said first and second cam means to prevent side loading of said pumping means.

10. An apparatus in accordance with claim 1 wherein said driving means comprise a synchronous electric motor and reduction gearing means and wherein said first and second cam means are mounted on the shaft of said motor.

11. An apparatus in accordance with claim 1 including housing support means on which said valve block means in removeably mounted.

12. An apparatus in accordance with claim 11 including pivotally mounted cover means.

13. A smoking machine for delivering predetermined volumes of smoke generated by drawing air through a tobacco product at a predetermined frequency interval comprising in combination a. pumping means comprising 1. a cylinder terminating in a valving extension having therein a fluid passage which communicates with a fluid chamber definable within said cylinder;
2. a piston terminating in a piston rod and movable within said cylinder, with a friction fit, thereby to determine the volume of said fluid chamber and hence the volume of said smoke delivered;
3. valve block means arranged to permit therein reciprocating motion of said valving extension of said cylinder and defining a gas inlet passage and a smoke discharge passage alternately in communication with said fluid passage in said valving extension in its reciprocating motion;
4. tobacco product holding means associated with said gas inlet passage arranged so that air pumped into said gas inlet passage is drawn through said tobacco product to form said smoke;
5. connector means associated with said smoke discharge passage arranged so that said smoke pumped through said discharge passage is directed into reservoir means;

b. driving means comprising 1. upper first cam means in the form of a circular disk having on its bottom side cam surfaces controlling the motion of said cylinder valving extension within said valve block means and the motion of said piston within said cylinder;
2. lower second cam means in the form of a circular disk, facing said bottom side of said first cam means, axially aligned therewith and spaced therefrom, said second cam means having spaced peripheral lifting ramps;

3. a drive pin engageable with said cam surfaces of said first cam means mounted transverse to the axis of said piston rod and arranged for translational movement therein from a lower to an upper position by engagement with one of said lifting ramps of said second cam means;
4. compressive spring means arranged to maintain said drive pin in said lower position whereby said drive pin engages said cam surfaces of said first cam means only when it is raised by one of said lifting ramps of said second cam means;
5. a synchronous motor, including gear reduction means, having a shaft on which said first and second cam means are mounted, said first cam means being attached thereto and said second cam means being free wheeling thereon;
6. gear means arranged to rotate said second cam means at an angular velocity less than that of said first cam means, the relative velocities of said cam means in combination with the spacing of said lifting wedges on said second cam means determining the frequency with which said first cam means is engaged by said driving pin and thereby the frequency with which said smoke is delivered to said reservoir means; and c. housing support means arranged to support said motor and on which said valve block means is removably mounted.

14. A smoking machine in accordance with claim 13 wherein said valving extension of said cylinder has sealing means and wiping ring means for sealing and cleaning the contacting surfaces of said valving extension and said valve block means.

15. A smoking machine in accordance with claim 13 including means to limit the extent of said reciprocating motion of said cylinder extension in said valve block means.

16. A smoking machine in accordance with claim 13 wherein said piston has sealing means and wiping ring means for sealing and cleaning the contacting surfaces of said cylinder and said piston.

17. A smoking machine in accordance with claim 13 wherein said valve block means includes a branch fluid passage in communication with said smoke discharge passage and a one-way air inlet valve associated with said branch fluid passage.

18. A smoking machine in accordance with claim 13 where said reservoir means is a tubing and wherein said tubing has a one-way gas discharge valve means and terminates in a breathing mask suitable for attaching to an animal subject.

* * * * *